US011618610B2

(12) United States Patent
Whitta et al.

(10) Patent No.: US 11,618,610 B2
(45) Date of Patent: Apr. 4, 2023

(54) BIN WITH FLIP LID

(71) Applicant: CREATIVE PLASTIC CONCEPTS, LLC, Sycamore, OH (US)

(72) Inventors: Jacob H. Whitta, Bluffton, OH (US); Ben Sayalith, Findlay, OH (US); Eric Hummel, Findlay, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 0 days.

(21) Appl. No.: 17/480,215

(22) Filed: Sep. 21, 2021

(65) Prior Publication Data

US 2022/0089324 A1 Mar. 24, 2022

Related U.S. Application Data

(60) Provisional application No. 63/082,529, filed on Sep. 24, 2020.

(51) Int. Cl.

| | |
|---|---|
| ***B65D 25/30*** | (2006.01) |
| ***B65D 21/02*** | (2006.01) |
| ***B65D 43/16*** | (2006.01) |
| ***B65D 1/22*** | (2006.01) |
| ***B65D 25/28*** | (2006.01) |

(52) U.S. Cl.

CPC ..... *B65D 21/0212* (2013.01); *B65D 1/22* (2013.01); *B65D 21/0233* (2013.01); *B65D 25/282* (2013.01); *B65D 43/163* (2013.01)

(58) Field of Classification Search

CPC ..... B65D 43/163; B65D 25/2826; B65D 25/2808; B65D 25/282; B65D 25/30; B65D 21/0219; B65D 21/064

See application file for complete search history.

(56) References Cited

U.S. PATENT DOCUMENTS

| | | | | |
|---|---|---|---|---|
| 3,960,289 | A * | 6/1976 | Panicci | B65F 7/00 220/756 |
| 4,364,489 | A * | 12/1982 | Alexeeff | B65D 43/163 220/826 |
| 4,798,304 | A | 1/1989 | Rader | |
| D312,162 | S | 11/1990 | Bolden | |
| 5,038,953 | A | 8/1991 | Radar | |
| 5,133,472 | A * | 7/1992 | Koda | B65D 25/28 220/769 |
| D389,310 | S | 1/1998 | Niemann et al. | |

(Continued)

*Primary Examiner* — Stephen J Castellano

(74) *Attorney, Agent, or Firm* — Ward Law Office; Jacob M. Ward

(57) ABSTRACT

The bin with flip lid device includes a main body and lid having a first portion and a second portion. The main body includes a plurality of sides, an upper surface, and a bottom surface. The main body further has a first handle arrangement and a second handle arrangement. Each of the handle arrangements are disposed on opposite sides of the upper surface of the main body. Each of the first portion and the second portion of the lid are also disposed on opposite sides of the upper surface of the main body. Each of the first portion and the second portion are hingedly connected along the upper surface of the main body. Each of the first portion and the second portion have at least one tooth which is configured to nest into a corresponding recess in each of the opposite lids where the device is in a closed position.

18 Claims, 7 Drawing Sheets

(56) References Cited

U.S. PATENT DOCUMENTS

| | | | | |
|---|---|---|---|---|
| 6,179,156 | B1 * | 1/2001 | Aiken | B65D 21/064 220/608 |
| 6,868,979 | B2 | 3/2005 | Rader | |
| D515,315 | S | 2/2006 | Radar et al. | |
| 7,721,912 | B2 | 5/2010 | Radar | |
| 8,348,076 | B2 | 1/2013 | Rader et al. | |
| 8,752,727 | B2 | 6/2014 | Niemann | |
| 8,757,412 | B2 | 6/2014 | Sommer et al. | |
| 10,377,535 | B2 | 8/2019 | Sommer | |
| 2001/0042266 | A1 * | 11/2001 | Schroader | E04H 4/1236 210/163 |
| 2005/0103797 | A1 | 5/2005 | Radar et al. | |
| 2006/0186123 | A1 * | 8/2006 | Baltz | B65D 43/165 220/324 |
| 2017/0081077 | A1 * | 3/2017 | Nilsson | B65D 43/02 |
| 2018/0273245 | A1 | 9/2018 | Sommer | |

* cited by examiner

BIN WITH FLIP LID

CROSS-REFERENCE TO RELATED APPLICATIONS

This application claims the benefit of U.S. Provisional Application No. 63/082,529 filed on Sep. 24, 2020. The entire disclosure of the above application is incorporated herein by reference.

FIELD

The present disclosure relates generally to storage containers and, more particularly, to storage containers with lids.

INTRODUCTION

This section provides background information related to the present disclosure which is not necessarily prior art.

Containers or bins with lids are commonly used for commercial and residential applications. It is typical to store articles such as tools, recreational equipment, supplies, materials, and the like in bins. A lid covers an open end of the bin to secure and protect the articles contained within the bin.

Such bins may be stored or transported in various arrangements such as by stacking the bins on top of or beneath other bins or other objects. However, certain bins and lids may lack stability to support other bins or objects that may be stacked thereupon. Also, bin lids may not sufficiently secure other bins or objects that may be stacked thereupon.

Another issue relating to use of bins for storing articles involves a lack of adequate handle arrangements for ergonomic lifting or movement of the bin or stacked bins. Inadequate handle arrangements may lead to poor structural performance and reduced user satisfaction. Managing placement, movement, and stacking of bins may also depend on handle access.

Accordingly, there is a continuing need for a bin and lid combination that provides adequate support and stability for stacking of the bin. Desirably, the bin and lid combination may also provide an ergonomic handle that enhances structural performance and increases user satisfaction.

SUMMARY

In concordance with the instant disclosure, a bin with flip lid device that provides adequate support and stability for stacking, which also has an ergonomic handle that enhances structural performance and increases user satisfaction, has been surprisingly discovered.

The bin with flip lid device has a main body and a lid. The lid may include a first portion and a second portion. The main body may have a plurality of sides, a bottom surface, and an upper surface. The main body may further include a handle arrangement. In a specific example, the handle arrangement may include a first handle arrangement and a second handle arrangement. Each of the first handle arrangement and the second handle arrangement may be disposed on opposite sides of the upper surface of the main body. The first portion and the second portion of the lid may also be disposed on opposite sides of the upper surface of the main body. The first portion and the second portion may be hingedly connected along the upper surface of the main body. Each of the first portion and the second portion may have at least one tooth which is configured to nest into a corresponding recess in each of the opposite portions of the lid.

In a particular embodiment, the main body has a first side, a second side, a third side, and a fourth side. The first handle arrangement may be disposed on the first side of the upper surface of the main body. The second handle arrangement may be disposed on the third side of the upper surface of the main body. The first portion of the lid may be disposed on the second side of the upper surface of the main body. The second portion of the lid may be disposed on the fourth side of the upper surface of the main body.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
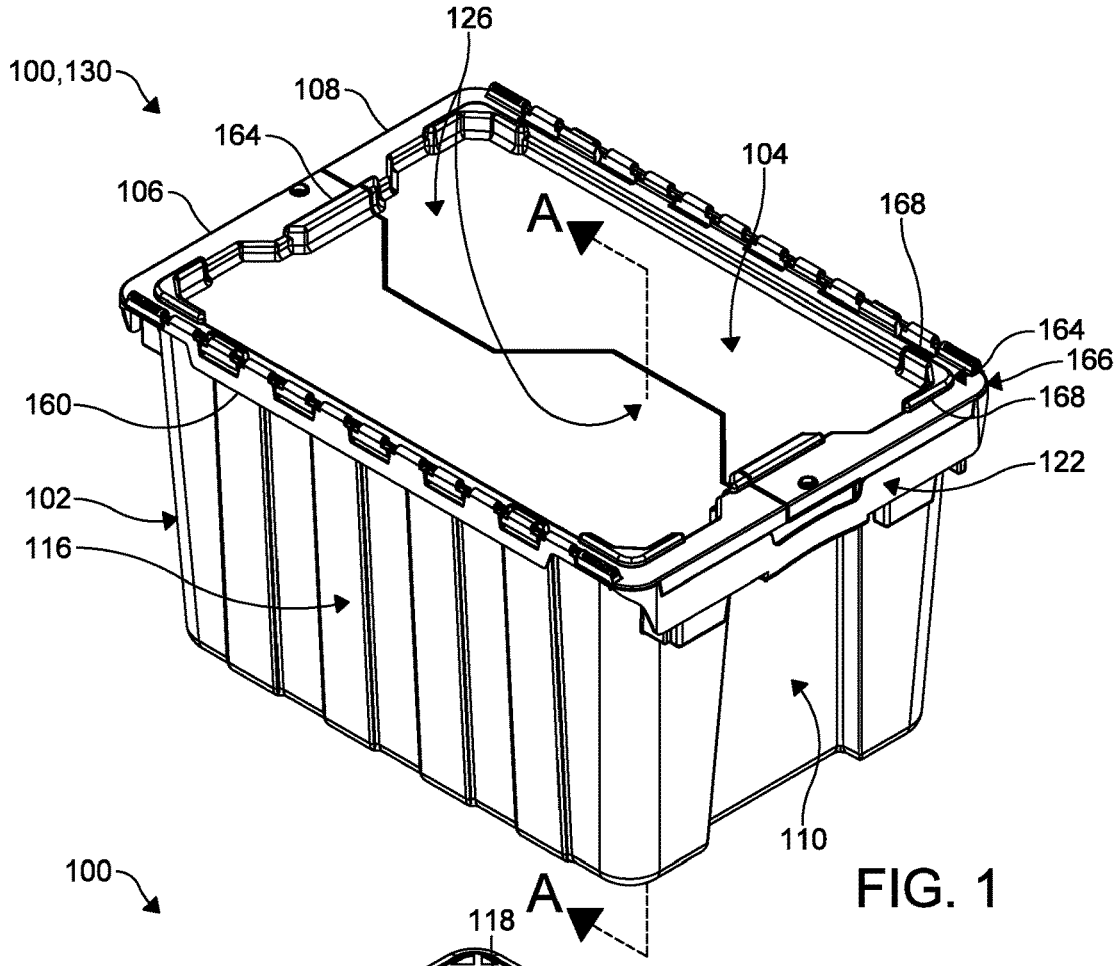
FIG. 1 is a top perspective view of a bin with flip lid device, according to one embodiment of the present disclosure.
Figure 2:
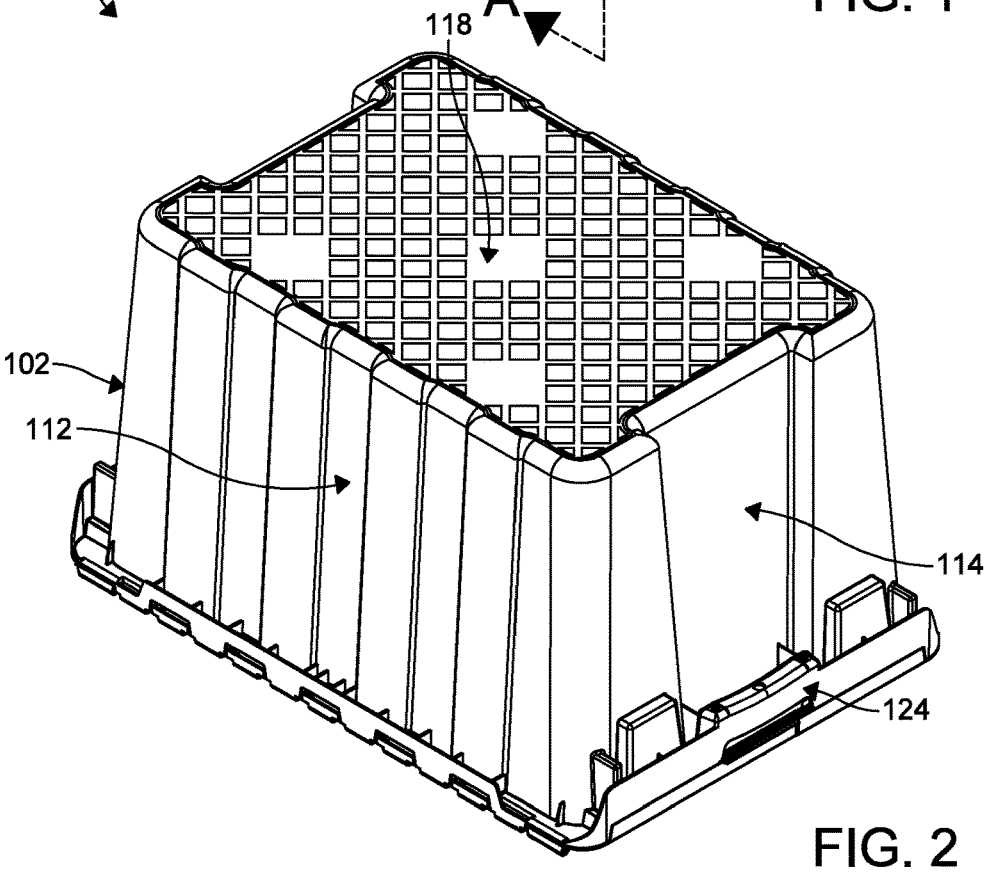
FIG. 2 is a bottom perspective view of the bin with flip lid device, as shown in FIG. 1.
Figure 3:
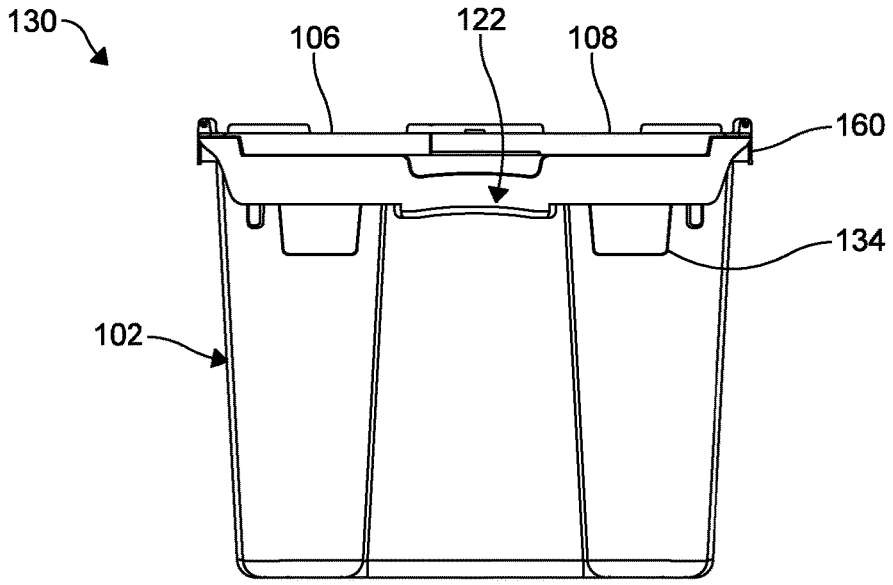
FIG. 3 is a front elevational view of the bin with flip lid device, as shown in FIGS. 1-2, further depicting the bin with flip lid device disposed in a closed position.
Figure 4:
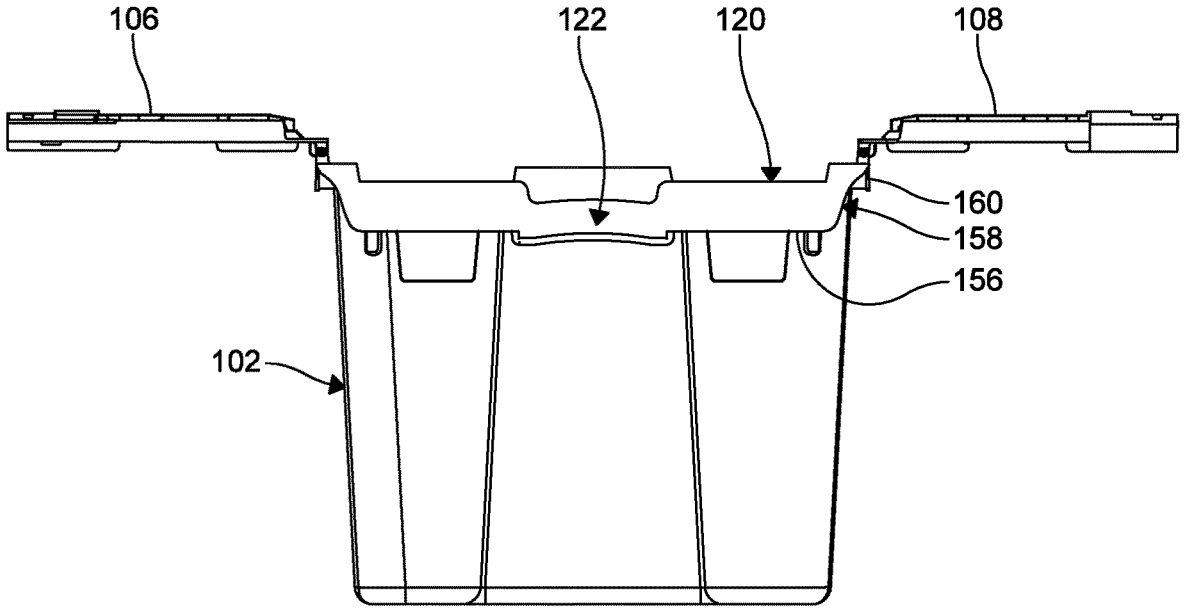
FIG. 4 is a front elevational view of the bin with flip lid device, as shown in FIGS. 1-3, further depicting the bin with flip lid device disposed in a partially opened position, according to one embodiment of the present disclosure.
Figure 5:
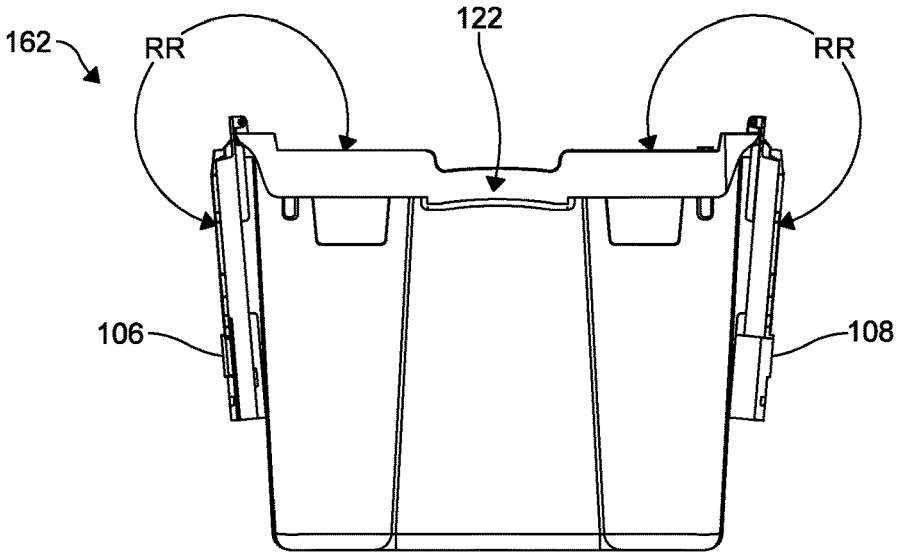
FIG. 5 is a front elevational view of the bin with flip lid device, as shown in FIGS. 1-4, further depicting the bin with flip lid device disposed in an opened position, according to one embodiment of the present disclosure.
Figure 6:
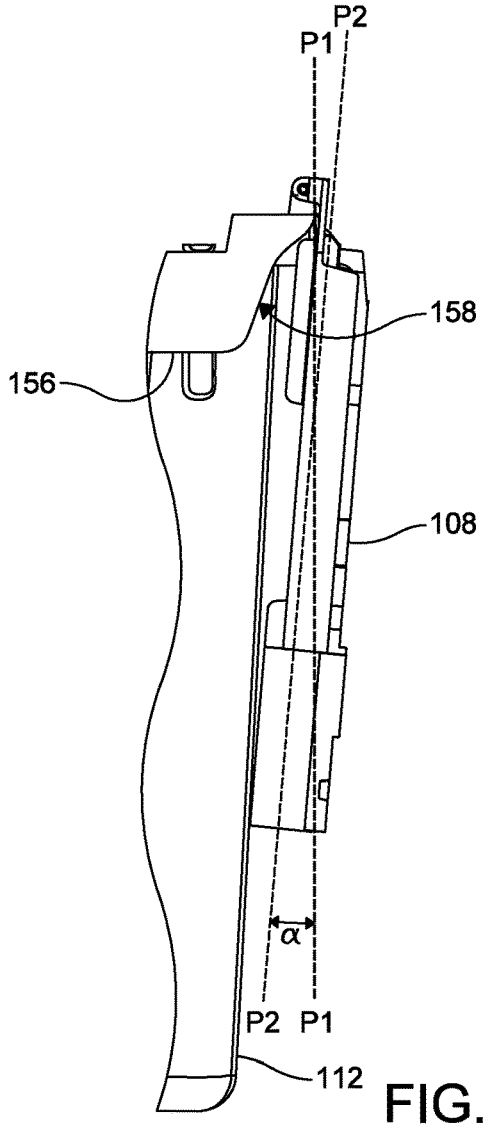
FIG. 6 is an enlarged front elevational view of the bin with flip lid device, as shown in FIG. 6, according to one embodiment of the present disclosure.
Figure 13:
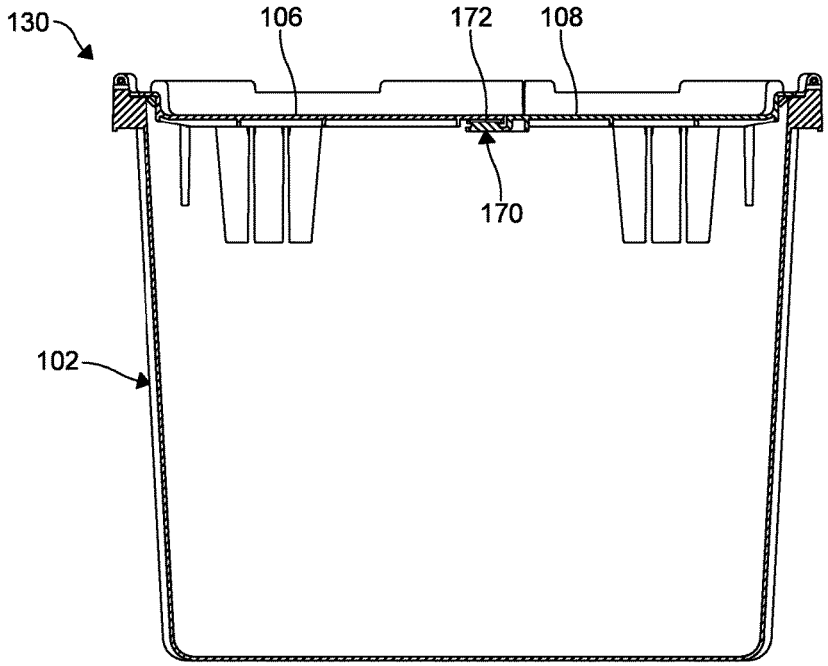
Figure 14:
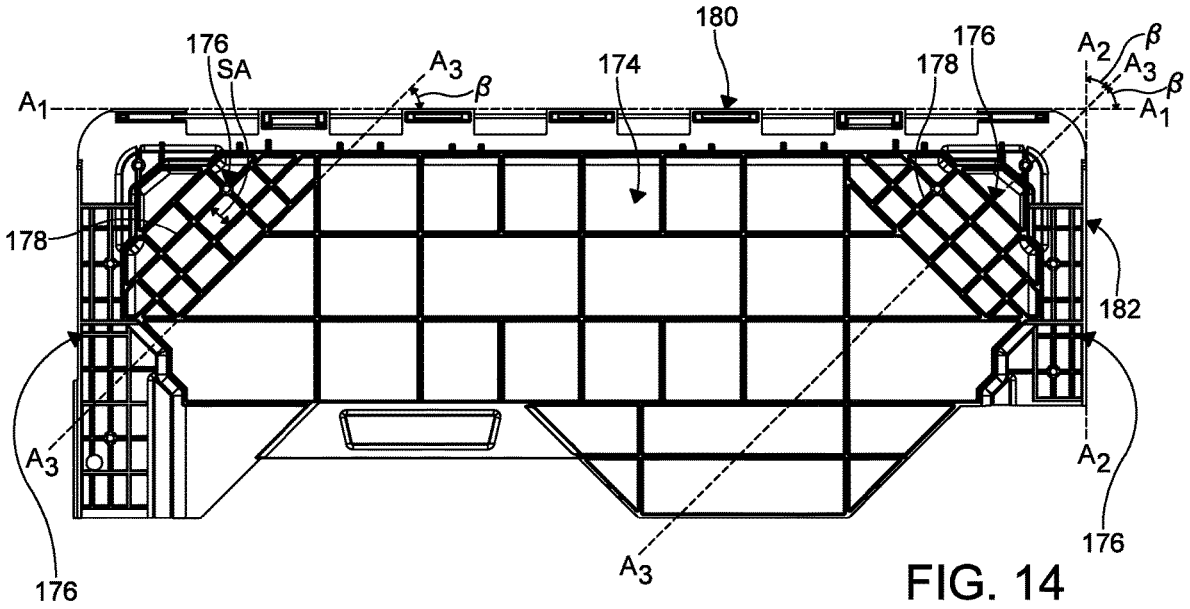

FIG. 13 is a front elevational cross-sectional view of the bin with flip lid device, taken at A-A in FIG. 1, further depicting a protrusion of the second portion of the lid coupled with a tooth of the first portion of the lid, according to one embodiment of the present disclosure; and FIG. 14 is a bottom plan view of the lid of the bin with flip lid device, further depicting a clustered ribbing, according to one embodiment of the present disclosure.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the FIGS. is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As shown in FIGS. 1-14, the bin with flip lid device 100 includes a main body 102 and a lid 104. The lid 104 may include a first portion 106, and a second portion 108. The main body 102 may have a plurality of sides 110, 112, 114, 116, a bottom surface 118, and an upper surface 120. The main body 102 may further include a handle arrangement 122, 124. In a specific example, the handle arrangement 122, 124 may include a first handle arrangement 122 and a second handle arrangement 124. Each of the first handle arrangement 122 and the second handle arrangement 124 may be disposed on opposite sides 110, 114 of the upper surface 120 of the main body 102. Each of the first portion 106 and the second portion 108 may also be disposed adjacent to opposite sides 112, 116 of the main body 102.

With reference to FIGS. 1, 3, 7, 10-11, and 13, each of the first portion 106 and the second portion 108 of the lid 104 may be hingedly connected along the upper surface 120 of the main body 102. Each of the first portion 106 and the second portion 108 may have at least one tooth 126 which is configured to nest into a corresponding recess 128 in each of the first portion 106 and the second portion 108 where the lid 104 is selectively disposed in a closed position 130.

In a particular embodiment, with reference to FIGS. 1-3, and 7, the main body 102 has a first side 110, a second side 112, a third side 114, and a fourth side 116. The first handle arrangement 122 may be disposed on the first side 110 of the upper surface 120 of the main body 102. The second handle arrangement 124 may be disposed on the third side 114 of the upper surface 120 of the main body 102. The first portion 106 of the lid 104 may be disposed on the second side 112 of the upper surface 120 of the main body 102. The second portion 108 of the lid 104 may be disposed on the fourth side 116 of the upper surface 120 of the main body 102.

In certain circumstances, as shown in FIGS. 3 and 8-10, the plurality of sides 110, 112, 114, 116 of the main body 102 may include a way to provide enhanced support where the bin with flip lid device 100 is provided in a nested orientation 132. For instance, the plurality of sides 110, 112, 114, 116 of the main body 102 may include a stacking structure 134. The stacking structure 134 may include a recessed area 136 and a rib 138. The rib 138 may be disposed substantially transverse to the bottom surface 118 of the main body 102. The recessed area 136 may include a lower wall 140. The rib 138 may include a top surface 142 that is substantially parallel with the lower wall 140. The top surface 142 of the rib 138 may be substantially planer with the upper surface 120 of the main body 102. In a specific example, the stacking structure 134 may be provided with a plurality of ribs 138. In a more specific example, recessed area 136 of the stacking structure 134 may be a substantially trapezoidal-shaped recess. Where the bin with flip lid device 100 is provided in the nested orientation 132, the main body 102 of the bin with flip lid device 100 may at least partially accept the main body 102 of another bin with flip lid device 100, such as when the bin with flip lid devices 100 are empty and nested together. In a specific example, the top surface of the rib 138 may be configured to support and be disposed underneath the lower wall 140 of the stacking structure 134 of another bin with flip lid device 100. Advantageously, the stacking structure 134 may be configured to create a space 144 between the handle arrangements 122, 124 of nested bin with flip lid devices 100 when disposed in the nested orientation 132. Desirably, the space 144 may allow the nested bin with flip lid devices 100 to be more ergonomically lifted and/or separated. One skilled in the art may select other suitable configurations of providing the stacking structure 134, within the scope of the present disclosure.

In certain circumstances, as shown in FIGS. 8-10 and 13, the stacking structure 134 may include ways to easily injection mold the stacking structure 134 in the main body 102. For example, the stacking structure 134 would be too weak if a thin wall was formed into the side 110, 114 of the main body 102. Conversely, the stacking structure 134 would be too difficult and too costly to manufacture on a large scale if the stacking structure was a large block formed into the side 110, 114 of the main body 102. Accordingly, the rib 138 configuration for forming the stacking structure 134 desirably provides adequate strength while also minimizing overall weight and material costs during manufacturing. In certain circumstances, the ribs 138 may be openly exposed to an interior space 146 of the main body 102, having no dividing wall between the ribs 138 and the interior space 146. Where there is no dividing wall between the ribs 138 and the interior space 146, the stacking structure 134 may require less tooling and less heat to manufacture. Advantageously, where the stacking structure 134 is provided without a dividing wall between the ribs 138 and the interior space 146, the mold for injecting the material constructing the bin with flip lid device 100 may have a larger opening to access the recessed area 136. One skilled in the art may select other suitable methods of forming the stacking structure, within the scope of the present disclosure.

Figure 11:
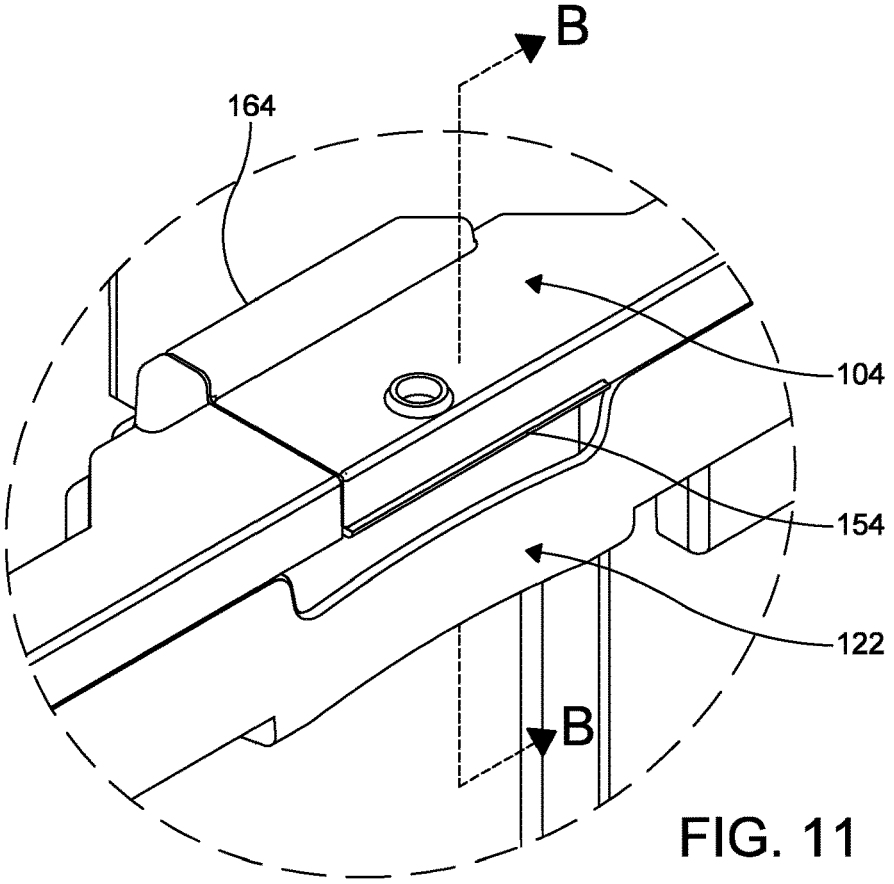
FIG. 11 is an enlarged top perspective view of the bin with flip lid device, further depicting a handle arrangement and a lip of the lid, according to one embodiment of the present disclosure.
Figure 12:
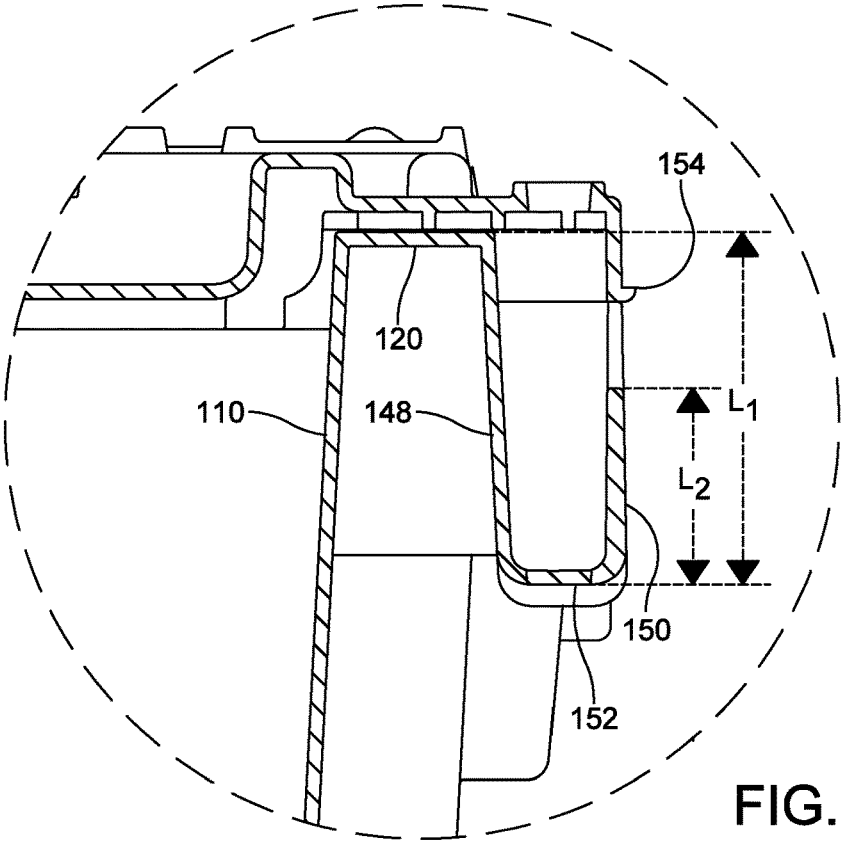
FIG. 12 is a left-side elevational cross-sectional view of the bin with flip lid device, taken at B-B in FIG. 11, further depicting the structure of the handle arrangement and the lip of the lid, according to one embodiment of the present disclosure.

In certain circumstances, as shown in FIGS. 11-12, the handle arrangement 122, 124 includes a substantially U-shaped cross-section have an inner wall 148, an outer wall 150, and a lower surface 152. The inner wall 148 may be coupled to the upper surface 120 of the main body 102. The inner wall 148 may be spaced apart from a side 110, 114 of the main body 102 with enough room to allow a user to insert their fingers into the spaced apart area when lifting the bin with flip lid device 100. The lower surface 152 may be shaped to have a concave arch configured to allow the bin with flip lid device 100 to be more ergonomically lifted. The inner wall 148 may have a first length L1 that is longer than a second length L2 of the outer wall 150. In other words, the top of the outer wall 150 may be spaced apart from the lid 104 when the lid 104 is disposed in the closed position 130. Desirably, this spacing allows a user to insert their fingers more easily beneath the lid 104 to open the bin with flip lid device 100.

In certain circumstances, the lid 104 may include a way to lift the lid 104 more ergonomically. For instance, the lid 104 may include a lip 154 disposed substantially adjacent to the handle arrangement 122, 124. The lip 154 may extend laterally from the lid 104. The lip 154 may be disposed substantially above the outer wall 150 of the handle arrangement 122, 124. The lip 154 may be configured to act as a touchpoint for the user to efficiently identify where the lid 104 may be more easily opened from. The lip 154 may also be configured to provide a wider surface than an edge of the lid 104 for the user to lift the lid 104 more comfortably. A skilled artisan may use other configurations to provide a wider surface for a user to lift the lid 104 more comfortably, within the scope of the present disclosure.

In certain circumstances, with reference to FIGS. 3-8, the bin with flip lid device 100 may include a way to enhance a rotational range RR of the first portion 106 and/or the second portion 108 of the lid 104. For instance, the main body 102 may include a flange 156 depending from the upper surface 120 and disposed adjacent to the handle arrangement 122, 124. The flange 156 may have a recessed corner 158. The recessed corner 158 may be substantially S-shaped. Advantageously, the recessed corner 158 of the flange 156 may militate against limiting the rotational range RR of the first portion 106 and/or the second portion 108.

The main body 102 may also include a downward protrusion 160 depending from the upper surface 120. In a specific example, the downward protrusion 160 may be disposed adjacent to the second side 112 and/or the fourth side 116 of the main body 102. The downward protrusion 160 may be oriented on a first plane P1. The first portion 106 and/or the second portion 108 of the lid 104 may selectively rotate to an open position 162 on a second plane P2. The second plane P2 may be disposed at an angle α that may be substantially transverse to the first plane P1, when the first portion 106 and/or the second portion 108 are disposed in the open position 162. As a non-limiting example, the angle α may be around five degrees. In another specific example, the first portion 106 and/or the second portion 108 of the lid 104 may have the rotational range RR to touch a side 112, 116 of the main body 102. For instance, as a non-limiting example, the first portion 106 and/or the second portion 108 of the lid 104 may have the capacity to rotate more than two-hundred seventy degrees.

In certain circumstances, the lid 104 may include ways to provide an enhanced alignment where another bin with flip lid device 100 is stacked atop the bin with flip lid device 100, where the lid 104 of the bin with flip lid device 100 is in the closed position 130. For instance, where the main body 102 of the bin with flip lid device 100 is full of desired contents, the lid 104 of the bin with flip lid device 100 may be placed in the closed position 130 and the another bin with flip lid device may be placed atop the closed lid 104. In a specific example, the lid 104 may include a boss 164 extending upwardly. The boss 164 may be sized, shaped, and oriented to accept and support the bottom surface 118 of the another bin with flip lid device 100. In certain circumstances, the boss 164 may include a plurality of bosses 164. For instance, the plurality of bosses 164 may be arranged to accept the another bin with flip lid device 100 where the bottom surface 118 meets the plurality sides 110, 112, 114, 116 of the another bin with flip lid device 100. In certain circumstances, the boss 164 may be disposed substantially adjacent to a corner 166 of the main body 102. Where the boss 164 is disposed substantially adjacent to the corner 166 of the main body 102, the boss 164 may have a plurality of arms 168 oriented transverse to each other. Where the lid 104 is disposed in the closed position 130, the plurality of arms 168 may be configured to support and align a bottom surface 118 of the another bin with flip lid device 100 stacked atop the closed bin with flip lid device 100. In another specific example, the boss 164 may be disposed substantially adjacent to the handle arrangement 122, 124. Advantageously, the boss 164 may militate against the another bin with flip lid device 100 stacked atop the closed bin with flip lid device 100 from unintentionally moving in a lateral direction. One skilled in the art may select other ways to provide enhanced alignment where another bin with flip lid device 100 is stacked atop the closed bin with flip lid device 100, within the scope of the present disclosure.

Figure 7:
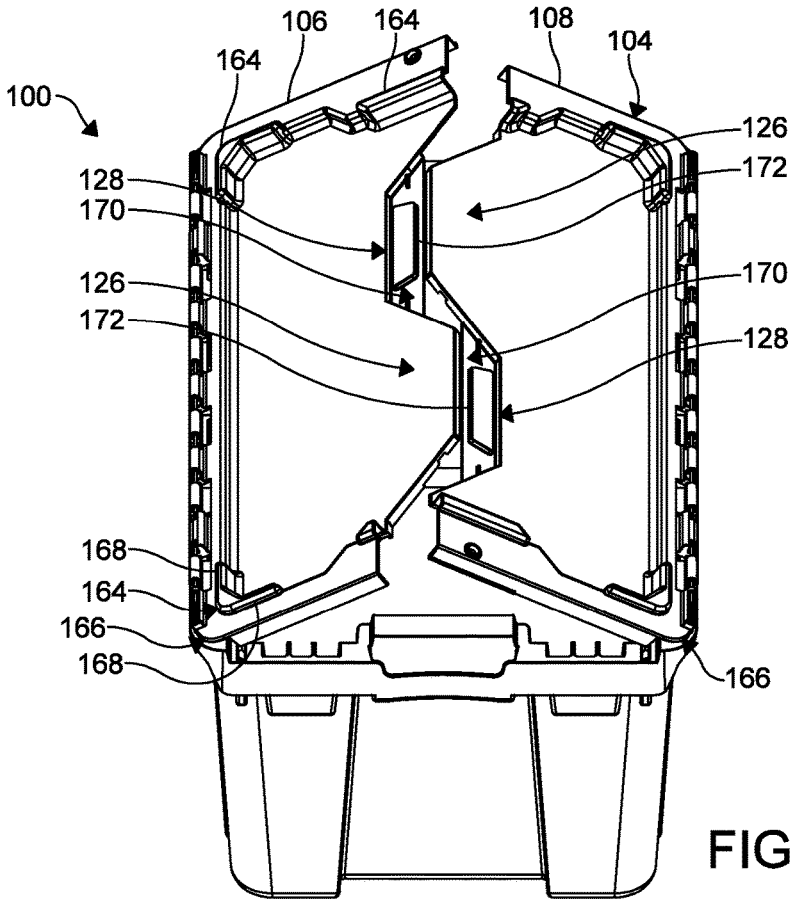
FIG. 7 is a top perspective view of a bin with flip lid device, further depicting the bin with flip lid device disposed in a partially opened position, according to one embodiment of the present disclosure.
Figure 8:
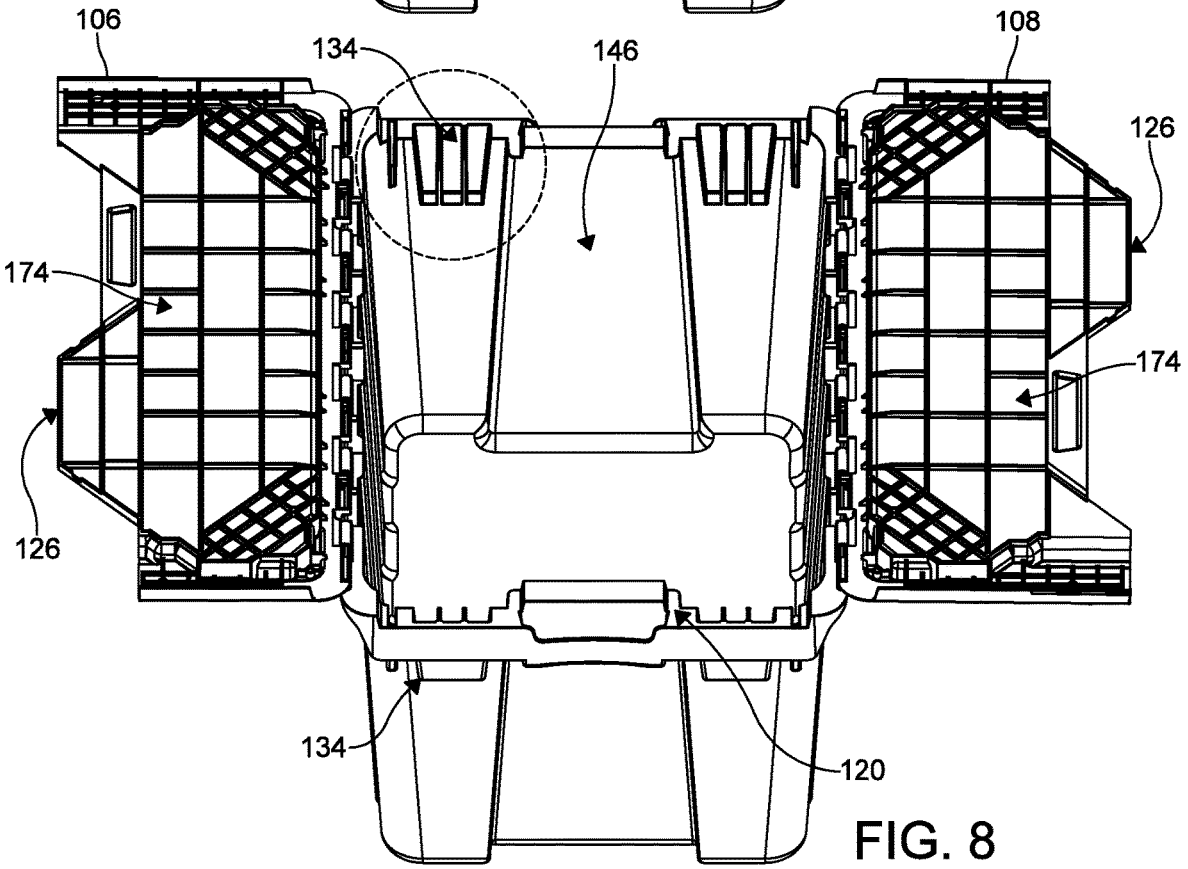
FIG. 8 is a top perspective view of a bin with flip lid device, as shown in FIG. 7, further depicting the bin with flip lid device disposed in a partially opened position, according to one embodiment of the present disclosure.
Figure 9:
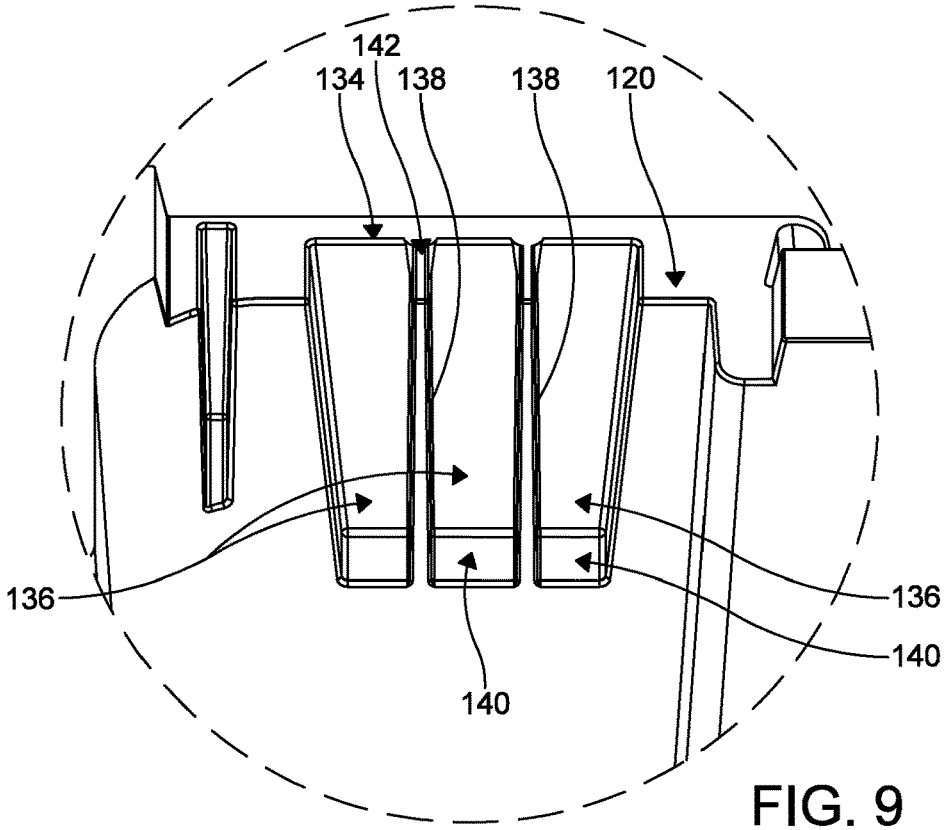
FIG. 9 is an enlarged top perspective view of the bin with flip lid device, further depicting an interior surface of a stacking structure, as shown in FIG. 8, according to one embodiment of the present disclosure.
Figure 10:
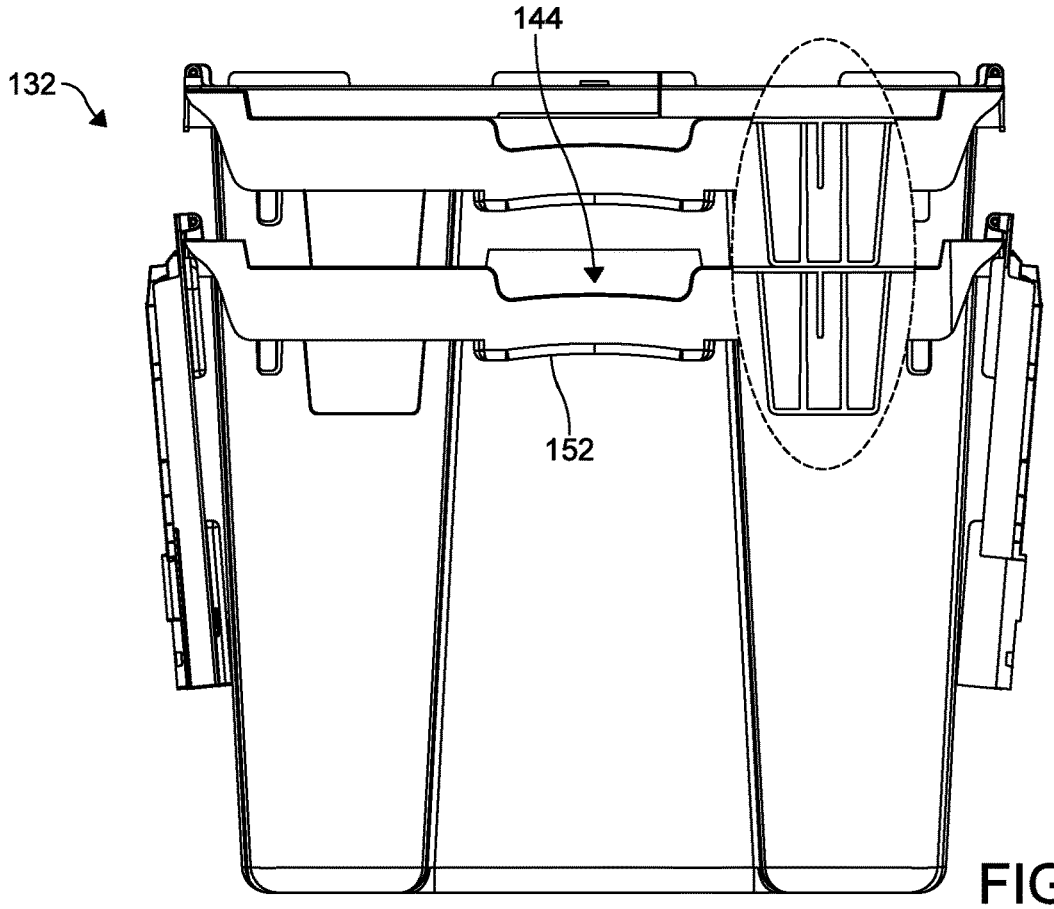
FIG. 10 is a front elevational view of the bin with flip lid device, as shown in FIG. 8, further depicting the bin with flip lid device disposed in a nested orientation with another bin with flip lid device, where a partially phantom view depicts the interior ribs of the stacking structures of the bins.

In certain circumstances, as shown in FIGS. 7-8 and 13, the bin with flip lid device 100 may include ways to enhance the structural integrity of the lid 104 in the closed position 130. For instance, the lid 104 may include an internal flange 170 extending from one or both of the first portion 106 and the second portion 108. The internal flange 170 may accept and be configured to support the other of the first portion 106 and the second portion 108. In a specific example, the internal flange 170 may accept and be configured to support the tooth 126 of the other of the first portion 106 and the second portion 108. The internal flange 170 may include a projection 172 that is configured to be accepted by the tooth 126 of the other of the first portion 106 and the second portion 108, when the bin with flip lid device 100 is provided in the closed position 130. Specifically, the projection 172 of the internal flange 170 may be selectively coupled to the tooth 126 of the other of the first portion 106 and the second portion 108 through a friction fit design. Advantageously, the selective coupling of the projection 172 of the internal flange 170 and the tooth 126 may be configured to militate against the lid 104 from sagging toward the internal space 146 of the main body 102 when a weight is applied to the lid 104. For instance, where the weight is applied to the lid 104, the tooth 126 of the first portion 106 may selectively interlock with the projection 172 of the second portion 108, thereby militating against the lid from sagging inwardly towards the internal space 146 of the main body 102. Likewise, the tooth 126 of the second portion 108 may selectively interlock with the projection 172 of the first portion 106.

In certain circumstances, as shown in FIG. 14, an underside 174 of the lid 104 may include a clustered ribbing 176 which strengths the lid 104 and may militate against the lid 104 from warping or bending. Each rib 178 of the clustered ribbing 176 may be spaced apart SA from adjacent ribs 178 by less than about one inch. In a more specific example, each rib 178 of the clustered ribbing 176 may be spaced apart SA from the adjacent ribs 178 by about half an inch. In an even more specific example, each rib 178 of the clustered ribbing 176 may be spaced apart SA from the adjacent ribs 178 by about 0.57 inches. In certain circumstances, the lid 104 may include a long side 180 and a short side 182. The long side 180 may include a first axis A1. The short side 182 may include a second axis A2. Each rib 178 of the clustered ribbing 176 may be oriented on a third axis A3 substantially transverse to the first axis A1 and the second axis A2. For instance, each rib 178 of the clustered ribbing 176 may be oriented at an angle β of about forty-five degrees from the first axis A1 and the second axis A2. The clustered ribbing 176 may be disposed adjacent to where each of the plurality of sides 110, 112, 114, 116 connect. In a particular embodiment, the clustered ribbing 176 may be disposed substantially adjacent to the handle arrangement 122, 124. In an even more particular embodiment, the clustered ribbing 176 may be defined as a plurality of ribs 178 formed in the shape of interconnected rectangles. Advantageously, the clustered ribbing 176 is believed to enhance the structural integrity of the lid 104. A skilled artisan may select other suitable methods of increasing the structural integrity of each of the first portion 106 and the second portion 108, within the scope of the present disclosure.

Advantageously, the bin with flip lid device 100 provides adequate support and stability for stacking, enhance structural integrity, and improved ergonomics for lifting and/or opening the bin with flip lid device 100.

While certain representative embodiments and details have been shown for purposes of illustrating the invention, it will be apparent to those skilled in the art that various changes may be made without departing from the scope of the disclosure, which is further described in the following appended claims.

What is claimed is:

1. A bin with flip lid device, comprising:

a main body, wherein the main body has an upper surface, a plurality of sides, and a bottom surface;

a lid including a first portion and a second portion, wherein the first portion is hingedly disposed on the upper surface of the main body, the second portion is hingedly disposed on the upper surface of the main body oppositely arranged from the first portion, and each of the first portion and the second portion further includes at least one tooth configured to nest within the other one of the first portion and the second portion when the lid is in a closed position; and a handle arrangement including a substantially U-shaped structure having an inner wall, an outer wall, and a lower surface, the inner wall coupled to the upper surface of the main body and having a first length that is longer than a second length of the outer wall, the lower surface having a concave arch configured to allow the bin with flip lid device to be more ergonomically lifted.

2. The bin with flip lid device of claim 1, wherein the plurality of sides of the main body includes a stacking structure configured to provide enhanced support where the bin with flip lid device is provided in a nested orientation.

3. The bin with flip lid device of claim 2, wherein the stacking structure includes a recessed area and a rib, the rib is disposed substantially transverse to the bottom surface of the main body, the recessed area includes a lower wall, and the rib includes a top surface that is substantially parallel with the lower wall.

4. The bin with flip lid device of claim 3, wherein the top surface of the rib is substantially planer with the upper surface of the main body.

5. The bin with flip lid device of claim 3, wherein the rib is openly exposed to an interior space of the main body.

6. The bin with flip lid device of claim 1, wherein the outer wall is spaced apart from the lid when the lid is disposed in the closed position.

7. The bin with flip lid device of claim 1, wherein the lid includes a lip disposed substantially adjacent to the handle arrangement.

8. The bin with flip lid device of claim 1, further comprising a flange depending from the upper surface of the main body and disposed adjacent to the handle arrangement, the flange having a recessed corner.

9. The bin with flip lid device of claim 1, further comprising a downward protrusion depending from the upper surface of the main body and oriented on a first plane, and at least one of the first portion and the second portion of the lid selectively rotates to an open position on a second plane, the second plane is substantially transverse to the first plane.

10. The bin with flip lid device of claim 1, wherein the lid includes a boss configured to provide an enhanced alignment to another bin stacked atop the lid in a closed position.

11. The bin with flip lid device of claim 10, wherein the boss is disposed substantially adjacent to a corner of the main body, the boss having a plurality of arms oriented transverse to each other.

12. The bin with flip lid device of claim 10, wherein the boss is disposed substantially adjacent to the handle arrangement.

13. The bin with flip lid device of claim 1, wherein the lid further includes an internal flange extending from one of the first portion and the second portion, the internal flange configured to accept and support the other of the first portion and the second portion.

14. The bin with flip lid device of claim 13, wherein the internal flange is configured to accept and support the tooth of the other of the first portion and the second portion.

15. The bin with flip lid device of claim 14, wherein the internal flange includes a projection that is configured to be accepted by the tooth of the other of the first portion and the second portion when the bin with flip lid device is provided in the closed position.

16. The bin with flip lid device of claim 1, wherein an underside of the lid includes a clustered ribbing, each rib of the clustered ribbing is spaced apart from adjacent ribs by less than about one inch.

17. The bin with flip lid device of claim 16, wherein a rib of the clustered ribbing is oriented substantially transverse to the sides of the main body.

18. The bin with flip lid device of claim 16, wherein the clustered ribbing is disposed substantially adjacent to the handle arrangement.

* * * * *